United States Patent [19]

Kobayashi

[11] Patent Number: 4,854,583

[45] Date of Patent: Aug. 8, 1989

[54] CONSTRUCTION OF PORTION CONNECTING GOLF CLUB-HEAD AND GOLF CLUB SHAFT

[75] Inventor: Masashi Kobayashi, Matsudo, Japan

[73] Assignee: Maruman Golf Co., Ltd., Tokyo, Japan

[21] Appl. No.: 298,278

[22] Filed: Jan. 13, 1989

Related U.S. Application Data

[63] Continuation of Ser. No. 77,930, Jul. 27, 1987, abandoned.

[30] Foreign Application Priority Data

Aug. 29, 1986 [JP] Japan ..... 61-201763

[51] Int. Cl.[4] ..... A63B 53/02

[52] U.S. Cl. ..... 273/80.8; 273/80.2; 403/292

[58] Field of Search ..... 273/80 R, 80 C, 80.2, 273/80.3, 80.5, 80.6, 80.8; 403/292, 277, 298

[56] References Cited

U.S. PATENT DOCUMENTS

| | | | |
|---|---|---|---|
| 184,718 | 11/1876 | Lewis | 403/292 X |
| 1,643,754 | 9/1927 | Sleith | 273/80.3 |
| 1,665,811 | 4/1928 | Hadden | 273/80.8 X |
| 1,997,853 | 4/1935 | Buhrke et al. | 273/80.6 |
| 2,630,857 | 3/1953 | Cohen | 403/292 X |
| 2,827,318 | 3/1958 | White, Jr. | 403/292 X |
| 3,334,901 | 8/1967 | Steffes | 403/292 X |
| 3,368,271 | 2/1968 | Scheffler | 273/80 R |
| 3,625,513 | 12/1971 | Ballmer | 273/80.5 |
| 4,614,343 | 9/1986 | Radway | 273/80.6 X |
| 4,691,818 | 9/1987 | Weber | 403/292 X |

FOREIGN PATENT DOCUMENTS

| | | | |
|---|---|---|---|
| 43-19887 | 8/1968 | Japan . | |
| 51-129857 | 10/1976 | Japan . | |
| 58-1337 | 12/1983 | Japan . | |
| 3489 | 11/1910 | United Kingdom | 273/80.3 |
| 4326 | 11/1911 | United Kingdom | 273/80.8 |

*Primary Examiner*—Robert E. Garrett
*Assistant Examiner*—Carl D. Price
*Attorney, Agent, or Firm*—Armstrong, Nikaido, Marmelstein, Kubovcik & Murray

[57] ABSTRACT

A construction of portion for connecting a golf club-head (11) and a golf club shaft, comprising a vertical first elongated hole (13) extended from the upper end of and toward a point midway in the neck member (12) of the golf club-head, and a vertical second elongated hole (14) having a smaller cross section and extended downward from the base of the first elongated hole (13) in the neck member (12) of the golf club-head (11). The hollow golf shaft fitted with a reinforcing pin (16) having upper and lower fitting portions (16c, 16c) is fitted into the first and second elongated holes (13, 14). This provides an improvement in the strength of the portion connecting the golf club-head (11) and the golf club shaft (15).

9 Claims, 1 Drawing Sheet

CONSTRUCTION OF PORTION CONNECTING GOLF CLUB-HEAD AND GOLF CLUB SHAFT

This application is a continuation of application Ser. No. 077,930 filed July 27, 1987.

BACKGROUND OF THE INVENTION

1. Field of the Invention

The present invention relates to a golf club, particularly to an improvement in the construction of a portion for connecting a golf club-head and golf club shaft.

2. Description of the Related Arts

Generally, a neck member of a golf club-head is provided with an elongated hole formed from the upper end toward a point midway in the neck member, and the lower end portion of a golf shaft is inserted into the elongated hole to connect the shaft with the neck member of the club-head. In such a case, a reinforcing core member is fitted into the lower end portion of the hollow shaft to improve the strength of the portion connecting the shaft and the neck member of the club-head.

In the conventional construction of such a connecting portion, since the hollow golf shaft is inserted into the elongated hole of the neck member, and the reinforcing core member is fitted into the lower end portion of the shaft, the strength of the neck member in which the shaft is inserted is very high. However, because of the presence of the elongated hole formed in the neck member, the sectional area of the neck member in which the shaft is inserted, and that of the neck member positioned beneath the lower end of the shaft, is radically changed, and thus stress is concentrated at the boundary surface defined by the base of the elongated hole, with the result that, upon impact with, for example, a golf ball, the neck member may fracture at that boundary surface.

Further, there is a recent trend for golf club-heads to be made of a light metal having a low specific weight, for example, aluminum, to increase the hitting surface area of the club-head. Such a club-head made of light metal has a low resistance to impact, compared with a club-head made of, for example, soft iron or stainless steel. Accordingly, the neck portion beneath the lower end of the golf shaft has a relatively low strength, with the result that this portion is easily fractured at the boundary surface thereof.

SUMMARY OF THE INVENTION

Accordingly, an object of the present invention is to provide a construction of a portion connecting a golf club-head and a golf shaft which will not fracture upon impact at the boundary surface of a neck portion of a golf club-head.

Therefore, according to the present invention, there is provided a construction of a portion connecting a golf club-head and a golf club shaft comprising: a first elongated hole formed vertically in a neck member of the golf club-head, and extended from the upper end toward a point midway in the neck member, this first elongated hole receiving a lower end portion of a golf club shaft; a second elongated hole having a smaller cross section than that of the first elongated hole, and formed vertically in the neck member, extended downward from a base of the first elongated hole formed vertically in the neck member; and a reinforcing pin made of a material having a greater strength than that of a material of which the golf club-head is made, and having an upper fitting portion to be fitted into a hollow space formed within the lower end portion of the golf club shaft, and a lower fitting portion to be fitted into the second elongated hole; whereby the golf club shaft is firmly and securely connected to the club-head by the fitting of the golf club shaft in the first hole, and by the fitting together of the golf club shaft, the reinforcing pin and the second elongated hole.

According to the present invention, the second elongated hole having a smaller cross section than that of the first elongated hole, in which the golf club shaft is inserted, is formed beneath the first elongated hole, and therefore, the stress is not concentrated at the boundary surface defined by the base of the first elongated hole. Accordingly, the possibility of a fracture upon impact at this boundary surface of the neck member is considerably reduced.

In addition, because the reinforcing pin made of a stronger material than that of the golf club-head is fitted into a continuous hole formed by the first and second elongated holes, the strength of the portion of the neck member around the first and second elongated holes can be remarkably increased; which also serves to prevent a fracture of the neck member of the golf club-head.

BRIEF DESCRIPTION OF THE DRAWINGS

The foregoing and other objects and advantages of the present invention will be better understood from the following description with reference to the preferred embodiments illustrated in the attached drawings; wherein.

DESCRIPTION OF THE PREFERRED EMBODIMENTS

Figure 1:
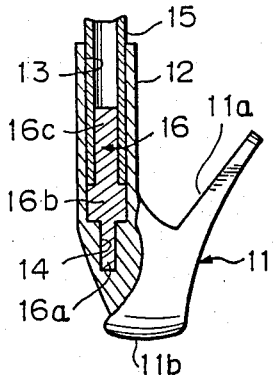
FIG. 1 is a partial cutaway side view of a first embodiment of the present invention applied to an iron golf club-head.
Figure 2:
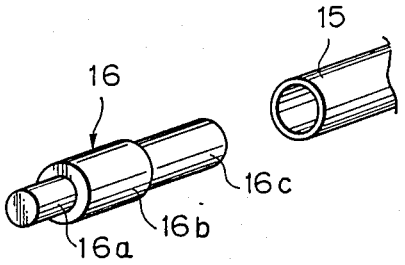
FIG. 2 is an exploded perspective view of the reinforcing pin and golf club shaft shown in FIG. 1.

FIGS. 1 and 2 show a first embodiment of the present invention applied to an iron golf club-head.

FIG. 1 shows a neck member 12 which is an integral part of a main body of a golf club-head 11. FIG. 1 is a partial cutaway side view taken seen from the heel side of the golf club-head, in which reference numerals 11a and 11b denote a hitting surface and a sole member of the golf club-head, respectively. A first elongated hole 13 is formed vertically in the neck member 12, and extends from the upper end of the neck member 12 to a point midway thereof, and is intended to receive a lower end portion of a golf club shaft 15. In this embodiment although the first elongated hole 12 is cylindrical, it may be a tapered hole having an upwardly increased diameter.

A second elongated hole 14 having a smaller cross section than that of the first elongated hole 13 is also formed in the neck member 12. This second elongated hole 14 is vertically extended downward from the base of the first elongated hole 13 in the neck member 12. In this embodiment, the second elongated hole 14 is also cylindrical, and is terminated in the vicinity of the lower portion of the neck member 12.

As shown in FIGS. 1 and 2, a reinforcing pin 16 made of a material having a greater strength than that of the golf club-head 11 includes an upper fitting portion 16c to be fitted into the hollow space of the golf club shaft 15, and adhered to the inner wall thereof by a suitable adhesive. This reinforcing pin 16 also has a lower fitting portion 16a to be fitted into the second elongated hole 14. In this embodiment, the reinforcing pin 16 further includes an intermediate fitting portion 16b to be fitted into the lower portion of the first elongated hole 13. This intermediate fitting portion 16b is formed between the upper and lower fitting portions 16c and 16a of the reinforcing pin 16. The shape and dimensions of these fitting portions 16a, 16b, and 16c correspond to those of the related holes 14, 13, and 15. Preferably, the entire outer surface of the reinforcing pin 16 may be roughened by, for example, knurling or shot blasting.

In the assembly of the first embodiment of the present invention, first the upper fitting portion 16c of the reinforcing pin 16 is fitted into and adhered to the hollow golf club shaft 15, then the lower end of the golf club shaft 15 fitted with the reinforcing pin 16 is inserted into the first elongated hole 13 of the neck member 12. Thus, the intermediate portion 16b and the lower fitting portion 16a of the reinforcing pin 16 are respectively fitted into the lower portion of the first elongated hole 13 and the second elongated hole 14. An adhesive is previously applied to the outer surfaces of the golf club shaft 15 and the reinforcing pin 16, or to the inner surfaces of the first and second elongated holes 13 and 14, and therefore, the golf club shaft 15 is firmly connected to the neck member 12 through the reinforcing pin 16. As mentioned above, when the outer surfaces of the reinforcing pin 16 are roughened, the adhesion of the reinforcing pin 16 to the golf club shaft 15 and the neck member 12 is considerably increased.

The golf club head 11 is made of a light metal, such as aluminum, and the reinforcing pin 16 is made of bronze, stainless steel, titanium, ceramic, fiber-reinforced metal, or fiber-reinforced plastic, or a combination of those materials. The golf club shaft is made of a metal, fiber-reinforced metal, or fiber-reinforced plastic, or a combination of those materials.

According to the first embodiment of the present invention, since the smaller sectioned second elongated hole 14 is formed beneath the first elongated hole 13, stress is not concentrated at the base of the first elongated hole 13, as in the prior art. In addition, since the reinforcing pin 16 is made of a stronger material than that of the club-head 11, the strength of the portions of the neck member 12 around the first and second elongated holes 13 and 14 can be remarkably increased.

Figure 4:
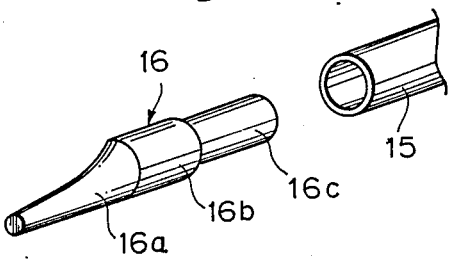
FIG. 4 is an exploded perspective view of the reinforcing pin and golf club shaft shown in FIG. 3; and, FIG. 5 is a partial cutaway side view of a third embodiment of the present invention applied to a wood golf club-head.
Figure 3:
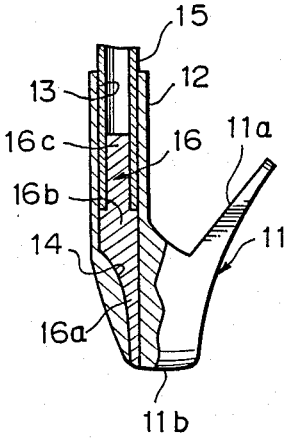
FIG. 3 is a partial cutaway side view of a second embodiment of the present invention applied to another iron golf club-head.

FIGS. 3 and 4 show a second embodiment of the present invention applied to another iron golf club-head, in which the same reference numerals as used in the first embodiment indicate the same or corresponding parts. In this embodiment, the second elongated hole 14 is extended to a sole surface 11b of the golf club-head 11 to form an opening thereon, and the cross section of the second elongated hole 14 is downwardly increased. Accordingly, stress is substantially uniformly distributed from the base of the first elongated hole 13 to the sole surface 11b, resulting in an increase in the strength of the portions of the neck member 12 around the first and second elongated holes 13 and 14.

As can be seen in FIG. 3, the opening is not formed on the side surface (right side of the Figure) of the neck member 12 because, if the side surface is smooth, the formation of such a hole thereon would detract from the aesthetic appearance of that surface.

As apparent from FIG. 3, the construction of the second embodiment has the same advantages as the first embodiment, with the additional factor that the second embodiment provides a greater protection against stress concentration.

Figure 5:
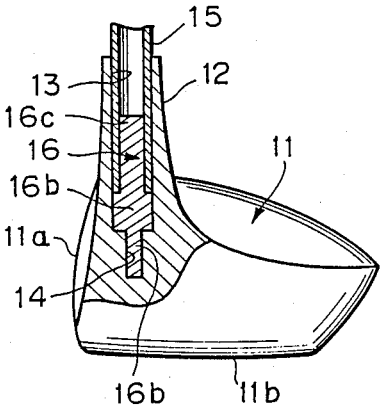

FIG. 5 shows a third embodiment of the present invention, applied to a wood golf club-head, in which the same reference numerals as used in the first embodiment indicate the same or corresponding parts. As shown in FIG. 5, the construction of the portion connecting the neck member 12 and the golf club shaft 15 is substantially the same as shown in the first embodiment. A wood golf club-head 11 is made of, for example, persimmon, and it is well known that a golf club-head made of wood has a weak point at the neck member 12 thereof. However, according to the present invention, since the lower fitting portion 16a of the reinforcing pin 16 is firmly fitted into the second elongated hole 14 of the neck member 12, the strength of the neck member 12 is greatly improved.

Although particular embodiments shown in the Figures and disclosure of the present invention have been described, it will be understood as a matter of course that the present invention is not limited thereto, since modifications can be made by those skilled in the art in the light of the foregoing teachings. For example, the shape of the second elongated hole can be modified as desired. Further, the present invention may be applied not only to a club-head for a iron or wood golf club, as in the foregoing embodiments, but also to a club-head for a putter. Accordingly, the appended claims cover any such modifications which may incorporate those features which come within the spirit and scope of the present invention.

I claim:

1. A connection structure between a golf club shaft and a club head comprising:

a golf club head having a neck member, said neck member being provided with a substantially vertical hole having an opening at a top end of said neck member, said hole having an upper large diameter section and a lower narrow section, said lower narrow section being displaced laterally from a vertical central axis of said large diameter section;

a hollow golf club shaft inserted into said upper diameter section, an outer diameter of said shaft being substantially identical to an inner diameter of said upper large section; and a reinforcing pin made of a material having a greater strength than that of said club head, said reinforcing pin having an enlarged cylindrical middle portion, a first fitting portion projecting from one end of said middle portion and a second fitting portion projecting from the other end of said middle portion and being displaced laterally from a vertical central axis of said middle portion, said first fitting portion being a cylindrical portion having an outer diameter being substantially identical to an inner diameter of said hollow golf club shaft, an outer diameter of said middle portion being substantially identical to said inner diameter of said upper large diameter section of said hole and an outer configuration of said second fitting portion being substantially identical to an inner configuration of said lower narrow section, wherein said reinforcing pin and hollow golf club shaft are inserted into said hole in that order in a manner such that said second fitting portion of said reinforcing pin engages within said lower narrow section of said hole, said enlarged cylindrical middle portion of said reinforcing pin engages within a lower end of said upper large diameter section of said hole, and said hollow golf club shaft engages within a clearance between said upper large diameter section of said hole and said first fitting portion of said reinforcing pin and further wherein said hollow golf club shaft, said portions and said sections are fixed tightly therein so as to constitute an integrally connected part with substantially no clearance therebetween.

2. A connection structure as claimed in claim 1, wherein said lower narrow section of said hole is extended to a sole surface of said golf club-head to form an opening therein.

3. A connection structure as claimed in claim 1, wherein said lower narrow section has a downwardly decreasing cross section of said hole.

4. A connection structure as claimed in claim 1, wherein said reinforcing pin is made of bronze.

5. A connection structure as claimed in claim 1, wherein said reinforcing pin is made of a stainless steel.

6. A connection structure as claimed in claim 1, wherein said reinforcing pin is made of titanium.

7. A connection structure as claimed in claim 1, wherein said reinforcing pin is made of a ceramic.

8. A connection structure as claimed in claim 1, wherein said reinforcing pin is made of a fiber-reinforced metal.

9. A connection structure as claimed in claim 1, wherein said reinforcing pin is made of a fiber-reinforced plastic.

* * * * *